United States Patent [19]

Day et al.

[11] 4,104,809

[45] Aug. 8, 1978

[54] COLOR SAMPLE DISPLAY DEVICE

[75] Inventors: Frederick A. Day, Hanover Park; Melvin D. Garbark, Schaumburg, both of Ill.

[73] Assignee: Color Communications, Inc., Melrose Park, Ill.

[21] Appl. No.: 728,301

[22] Filed: Sep. 30, 1976

[51] Int. Cl.[2] ..... B44D 2/00

[52] U.S. Cl. ..... 35/28.5; 40/492

[58] Field of Search ..... 33/168 R; 35/28.3, 28.5; 40/67; 401/99; 416/70 A, 71, 72, 73

[56] References Cited

U.S. PATENT DOCUMENTS

| | | | |
|---|---|---|---|
| 454,844 | 6/1891 | Brewerton | 40/67 |
| 1,588,633 | 6/1926 | Taylor | 401/99 |
| 1,911,788 | 5/1933 | Bergaud | 401/99 X |
| 1,958,192 | 5/1934 | Fletcher | 35/28.5 |
| 2,313,174 | 3/1943 | Shock | 33/168 X |

FOREIGN PATENT DOCUMENTS

| | | | |
|---|---|---|---|
| 1,349,444 | 12/1963 | France | 35/28.5 |
| 1,218,321 | 6/1966 | Fed. Rep. of Germany | 35/28.5 |
| 2,318,302 | 11/1973 | Fed. Rep. of Germany | 40/67 |
| 24,363 of | 1912 | United Kingdom | 33/168 R |
| 699,787 | 11/1953 | United Kingdom | 35/28.5 |

*Primary Examiner*—Harland S. Skogquist
*Attorney, Agent, or Firm*—Fitch, Even, Tabin & Luedeka

[57] ABSTRACT

A compact color sample display device is disclosed which includes a plurality of discrete strips each of which has one or more color samples thereon, such as paint color samples. The strips are supported in stacked relation on a support shaft which is slidable within a rectangular tubular case such that the strips may be disposed within the case or moved to an outward position and selectively fanned to facilitate display and selection of sample colors.

4 Claims, 3 Drawing Figures

COLOR SAMPLE DISPLAY DEVICE

The present invention relates generally to color sample display devices, and more particularly to a compact color sample display device wherein a plurality of discrete strips having color samples, such as paint color, thereon are supported by a casing for movement from an internal compact substantially totally enclosed position to an outward position wherein the strips are retained by the casing but may be selectively fanned to facilitate observation and selection of sample colors.

It is a conventional practice in the manufacture and merchandising of paints to provide color samples from which a particular color may be selected preparatory to purchasing larger quantities of paint. One known method by which color samples are presented is to provide color sample brochures or booklets having flat pages of color samples. When many different colors and shades are available, the booklets displaying the various color samples may become extremely bulky and cumbersome. This is particularly inconvenient for decorators and contractors who must carry paint color samples with them to their customers when advising the customers on home or commercial decorating. There thus exists the need for a compact easily transportable device which facilitates display and selection of color samples in a quick and easy manner.

It is a primary object of the present invention to provide a color sample display device which greatly facilitates the selection of particular colors, such as paint color samples, from a plurality of color samples presented on discrete strips, each strip having a plurality of color stripes thereon which may comprise varying shades of a color group or family of colors. In accordance with the invention, a plurality of equal size strips, selected ones of which have color sample stripes thereon, are supported in stacked relation on a support shaft which is slidable within elongated slots in a rectangular tubular case. The strips are movable from a compact position disposed within the case wherein they are substantially totally enclosed and protected to an outward extended position wherein the strips are retained by the case but may be fanned to facilitate observation and selection of desired colors. A feature of the invention lies in providing means on the casing to selectively retain the color strips in their inward enclosed and outwardly extended positions. Another feature lies in providing indicia on one or more of the upper strips which indicates the stack location, i.e. the numerical strip number, of particular color samples. The strips are preferably made of a flexible paper material to allow fanning of the strips either in a direction generally perpendicular to the planes of the strips or in directions lying in the planes of the strips, whereafter the strips may be readily reinserted within the casing.

In accordance with the invention, a compact inexpensive color sample display device is provided which greatly facilitates display and selection of particular colors from a multitude of color samples, the device serving to enclose and protect the color samples while in a stored position but facilitating fanning of the color sample strips while extended outwardly from but retained by the casing.

The various features and advantages of the invention will become apparent from the following detailed description of the invention when taken in conjunction with the accompanying drawing wherein like reference numerals designate like elements throughout the several views, and wherein.

Figure 1:
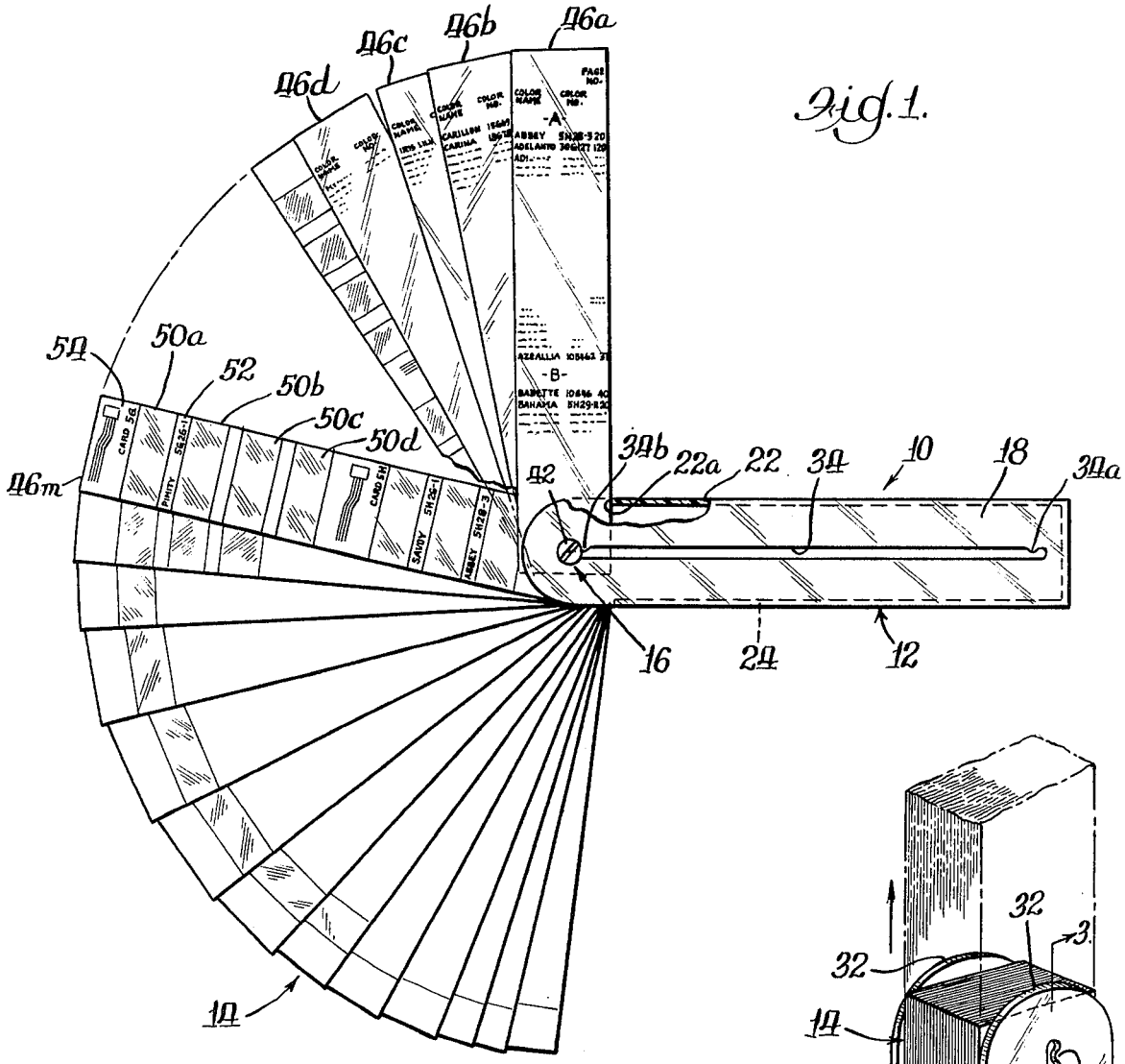
FIG. 1 is a plan view of a color sample display device constructed in accordance with the present invention, the display strips being shown in outwardly extended fanned positions to expose color stripes on the strips.

Referring now to the drawing, a color sample display device in accordance with the present invention is indicated generally at 10. The color sample display device 10 finds particular application for displaying paint samples and includes case or housing means, indicated generally at 12, adapted to support a plurality of discrete color sample strips, indicated generally at 14, through a support shaft or pin, indicated generally at 16, so that the color sample strips 14 may be moved from a first compact superimposed position substantially enclosed within and protected by the case means 12 to an outwardly extending position to facilitate fanning of the color sample strips for visual observation and selection of color samples while being retained by the case and support shaft.

The case means 12 comprises a rigid rectangular tubular case having a first pair of parallel spaced side walls 18 and 20 which, in the illustrated embodiment, may be termed the upper and lower walls, respectively, of the case 12. The walls 18 and 20 are integrally connected at their lateral edges to upstanding side walls 22 and 24 so as to define a rigid rectangular tubular case having an internal chamber 26. An end wall 28 serves to close one end of the chamber 26 which is open at its opposite end 30. The walls 18 and 20 are rounded at their forward ends 32 adjacent the opening 30. The walls 22 and 24 terminate at forward edges **22*a* and 24*a*, respectively, spaced longitudinally rearwardly from the forward ends 32 of the walls 18 and 20**.

The case 12 is preferably made of a suitable plastic material which lends itself to conventional extrusion molding techniques and provides the desired rigidity. It will be understood that other materials may also be used for the case, although plastic is preferable because of its adaption to molding techniques. The upper and lower walls 18 and 20 are provided with elongated slots 34 and 36, respectively, which are in vertical alignment and extend longitudinally of the case 12. The slots 34 and 36 define guideways which receive the opposite ends of the support shaft 16 in a manner to facilitate movement of the support shaft longitudinally of the case 12 within the guideways. To this end, the support shaft 16 comprises a cylindrical shaft 38 having an enlarged head portion 40 disposed outwardly of the slot 36 and having a removable enlarged head 42 to facilitate assembly of the support shaft 16 with the case 12, the enlarged head 42 being secured to the shaft 38 by threaded connection or other suitable connection so that the enlarged heads 40 and 42 limit axial movement of the support shaft 16 relative to the case 12.

The support shaft 16 serves to support and guide the color sample strips 14 for movement between a first position received within the internal chamber 26 of case 12 wherein the color sample strips are substantially totally enclosed and protected, and a second position extending outwardly of the open end 30 of chamber 26 wherein the color sample strips are adapted for fanning.

To define forward and rearward positions for the support shaft 16 and color sample strips 14 mounted thereon, and to selectively retain the shaft 16 in such forward and rearward positions, the slots 34 and 36 are provided with retaining or locking detents adjacent each end of the respective slots, as indicated at 34*a*, 34*b* and 36*a*, 36*b*. The detents 34*a*, 34*b* and 36*a*, 36*b* are aligned in pairs and are of sufficient size and location to allow the shaft 16 to be biased past the detents to either end of the slots 34 and 36, with the detents then retaining the shaft in the selected end positions until a force is applied to move the shaft toward the opposite end of the slots.

Figure 2:
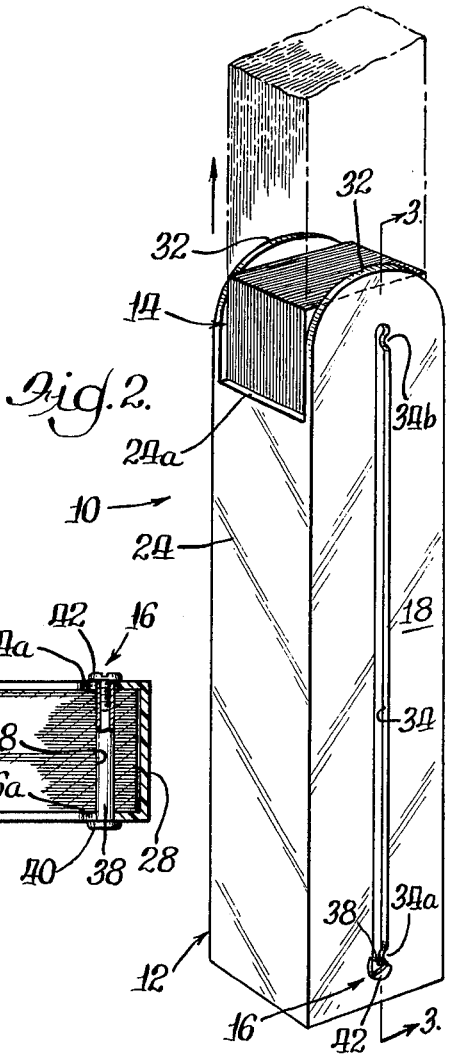
FIG. 2 is a perspective view of the display device of FIG. 1 but with the color sample strips shown in their retracted positions within the case.
Figure 3:
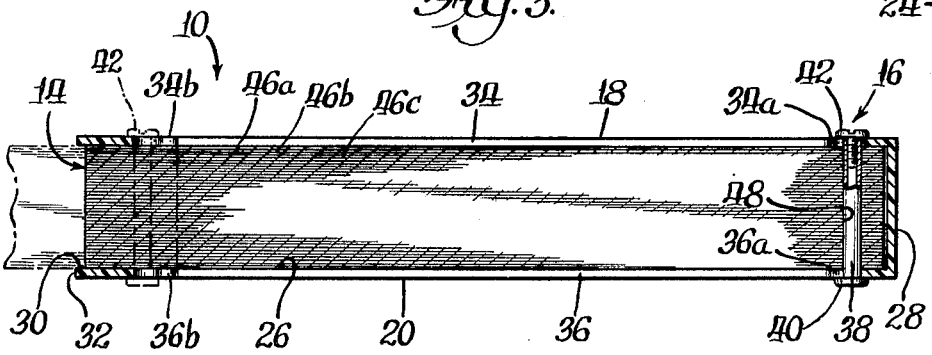
FIG. 3 is a longitudinal sectional view taken substantially along the line 3—3 of FIG. 2.

The color sample strips 14 include a plurality of rectangular strips 46*a, b, c, d*, etc. which are preferably made of a flexible paper or fiberboard material suitable for printing color samples and associated identifying indicia thereon. The strips 46*a, b, c*, etc. are of equal rectangular configuration having transverse widths slightly less than the width of the case 12 between the upstanding walls 22 and 24, and having longitudinal lengths slightly less than the length of the upper and lower walls 18 and 20. Each of the strips 46*a, b, c*, etc., has a suitable opening 48 in one end thereof to receive the support shaft 16 therethrough so that a plurality of the strips may be superimposed in stacked relation and inserted within the chamber 26 of case 12 whereafter the support shaft 16 is inserted through the openings 48 and secured within the guide slots 34 and 36. In this manner, the color sample display strips 46 may be fully inserted within the case 12, as shown in FIGS. 2 and 3, or may be moved to positions extending outwardly of the chamber 26 as shown in FIG. 1. Withdrawal of the color sample strips from within the case 12 is facilitated by the shortened upstanding side walls 22 and 24 which allow grasping of the side edges of the color sample strips 14 and movement thereof to their outward extending positions.

With particular reference to FIG. 1, the majority of the color sample strips 46*a, b, c, d*, etc., have a plurality of color sample stripes, as indicated at 50*a, b, c, d*, etc. on strip 46*m*, disposed thereon in transverse relation. The color strips 50*a, b, c*, etc., may represent various shades of any selected family of colors and are spaced apart to facilitate printing of identifying indicia, indicated at 52, adjacent each of the color sample stripes. Each of the color sample strips 46 has an identifying code, such as a strip number or other identifying code, imprinted thereon as indicated at 54 in FIG. 1.

One or more of the uppermost strips 46 is preferably provided with indicia thereon so as to form an index indicating the particular card in the stack upon which a listed color may be found. As seen in FIG. 1, the uppermost strip 46*a* is provided with columns which indicate color names, corresponding identifying color numbers, and the number or page of the underlying remaining strip 46 upon which a particular selected color sample may be found. The upper index cards preferably have the color names imprinted thereon in alphabetical and/or numerical order.

Thus, in accordance with the present invention, a color chart display device is provided wherein many color samples may be readily displayed for visual observation and assistance in selection of particular colors. The device is compact yet facilitates display of a great many color samples and allows selective grouping of various shades of color families. By moving the color sample strips from a protected position within the case 12 to an outward extended position, one or more of the color sample strips may be angularly separated from the remaining strips, or alternatively, the whole stack of color sample strips may be fanned as shown in FIG. 1 allowing visual observation of substantially the whole color spectrum. The stack of color sample strips may also be fanned in a direction generally perpendicular to the flat strips if desired. By providing the upstanding walls 22 and 24 with set-back forward edges 22*a* and 24*a*, respectively, the sample color strips 46 may be readily grasped and removed from the case 12 and fanned to approximately 180°.

While a preferred embodiment of the present invention has been illustrated and described, it will be obvious to those skilled in the art that changes and modifications may be made therein without departing from the invention in its broader aspects. Various features of the invention are defined in the following claims.

What is claimed is:

1. A color sample display device comprising, a case having an internal chamber open on at least one end and bounded by at least two side walls, said two side walls defining opposed elongated slots extending through said side walls and extending along the longitudinal lengths thereof, a support shaft having opposite ends received in and guided by said opposed slots for longitudinal movement along the lengths of said slots, said support shaft having enlarged head ends disposed outwardly of each of said slots and axially retaining said shaft within said slots, a plurality of discrete display strips pivotally carried by said support shaft, said display strips being of substantially equal size and being movable between a first position received within said internal chamber and a second position extending outwardly of said open end of said chamber, said display strips being in superimposed stacked relation when received within said chamber and being capable of movement to selectively fan one or more of said strips from the remainder of said strips when in said second position, selected ones of said strips having a plurality of color stripes disposed transversely thereon along the length thereof, said stripes on each of said selected ones of said strips being spaced from each other and identified by coded indicia, descriptive indicia on each of said selected ones of said strips adjacent each color stripe, and at least one of the uppermost of said plurality of display strips having indicia thereon indicating the particular one of the remaining strips on which a named color may be found.

2. A color sample display device as defined in claim 1 wherein at least one of said enlarged head ends is releasably secured to said support shaft to facilitate selective removal and replacement of display strips from said device.

3. A color sample display device as defined in claim 1 including retaining detents extending within said slots adjacent at least one end thereof for selectively retaining said shaft at said one end of said slot until biased toward the opposite end of said slot by manipulation of said strips.

4. A color sample display device as defined in claim 3 including retaining detents formed integral with said side walls and extending within said slots adjacent both ends thereof.

* * * * *